US008104622B2

(12) United States Patent
Soto

(10) Patent No.: US 8,104,622 B2
(45) **Date of Patent: *Jan. 31, 2012**

(54) CYCLONE SEPARATOR HAVING AN INLET HEAD

(75) Inventor: Oscar Castro Soto, Santiago (CL)

(73) Assignee: Vulco, S.A., Santiago (CL)

( * ) Notice: Subject to any disclaimer, the term of this patent is extended or adjusted under 35 U.S.C. 154(b) by 388 days.

This patent is subject to a terminal disclaimer.

(21) Appl. No.: 12/250,387

(22) Filed: Oct. 13, 2008

(65) Prior Publication Data

US 2009/0071880 A1 Mar. 19, 2009

Related U.S. Application Data

(63) Continuation-in-part of application No. 10/569,671, filed on Feb. 27, 2006, now Pat. No. 7,434,696.

(30) Foreign Application Priority Data

Aug. 29, 2003 (AU) ..... PCT/AU2004/001152
Aug. 29, 2003 (CL) ..... 1757-2003

(51) Int. Cl.
*B04C 5/02* (2006.01)

(52) U.S. Cl. ..... 209/732

(58) Field of Classification Search ..... 209/727, 209/732–734; 210/512.1
See application file for complete search history.

(56) References Cited

U.S. PATENT DOCUMENTS

| | | | | |
|---|---|---|---|---|
| 2,757,581 | A | 8/1956 | Boadway et al. | |
| 2,849,930 | A | 9/1958 | Boadway et al. | |
| 4,344,538 | A | 8/1982 | Fujisawa et al. | |
| 5,518,695 | A | 5/1996 | Goodspeed et al. | |
| 5,958,094 | A | 9/1999 | Schwambom et al. | |
| 6,258,146 | B1 | 7/2001 | Semedard | |
| 7,185,765 | B2 | 3/2007 | Hakola | |
| 7,255,790 | B2 * | 8/2007 | Rogers et al. | 210/512.1 |
| 7,434,696 | B2 * | 10/2008 | Soto | 209/732 |

FOREIGN PATENT DOCUMENTS

| | | | |
|---|---|---|---|
| DE | 3524789 | A1 | 1/1987 |
| SU | 1217-487 | A | 3/1986 |
| SU | 1625-531 | A | 2/1991 |
| WO | WO 86/01130 | | 2/1986 |

* cited by examiner

*Primary Examiner* — Joseph C Rodriguez
(74) *Attorney, Agent, or Firm* — Morriss O'Bryant Compagni

(57) ABSTRACT

A cyclone structured for separating feed material having mixtures of differently sized material, the cyclone having a separating section and an inlet head having a feed inlet zone, wherein the feed inlet zone has a volute axis and adjacent sectors in which the volute axis progressively decreases relative to and in the direction of the central axis through subsequent sectors extending downstream from the inlet port of the inlet head. The inlet head is also structured with a vortex finder extending into the feed chamber a distance L1, and an inlet port formed in the inlet head which extends a vertical distance H1, such that the ratio of L1 to H1 is less than one (L1:H1=0.0 to 0.95).

2 Claims, 4 Drawing Sheets

CYCLONE SEPARATOR HAVING AN INLET HEAD

CROSS-REFERENCE TO RELATED APPLICATION

This application is a continuation-in-part application of non-provisional application Ser. No. 10/569,671, filed Feb. 27, 2006 under 35 U.S.C. §371(c) and having an International filing date of Aug. 27, 2004, now issued as U.S. Pat. No. 7,434,696, the contents of which are hereby incorporated by reference.

BACKGROUND OF THE INVENTION

1. Field of the Invention

This invention relates generally to cyclone separators for separating or classifying materials and components therefor.

2. Description of Related Art

One particular application of the present invention concerns the provision of a cyclone for separating or classifying slurries in the mineral processing industry. The improvements in the cyclone separator of the present invention are not limited to that particular application and may find use in the separation of other materials.

Various types of separation or classification apparatus are used in the mineral industry, one commonly used apparatus being hydrocyclones. There is an ongoing need for apparatus to increase the throughput capacity, decrease the cut size, and improve the efficiency of operation of the equipment. To significantly increase the throughput capacity, it has in the past been necessary to increase the size of the hydrocyclone. Increasing the size of the hydrocyclone, however suffers from the disadvantage that it generally results in a bigger cut size and reduced efficiency.

BRIEF SUMMARY OF THE INVENTION

In accordance with the present invention, a cyclone is structured to improve throughput capacity and processing efficiency by providing a separating section having a central axis and an inlet head having a feed inlet zone, wherein the feed inlet zone has a volute axis and adjacent sectors in which the volute axis progressively decreases relative to and in the direction of the central axis through subsequent sectors extending downstream from the inlet port of the inlet head. The inlet head is also structured with a vortex finder which extends into the feed chamber a distance L1, and an inlet port formed in the inlet head which extends a vertical distance H1, such that the ratio of L1 to H1 is less than one (i.e., L1:H1=0.0 to 0.95).

The cyclone of the present invention comprises a separating section having a central axis and a continuous conical wall defining a first end with a larger radius and a second end with a smaller radius. An inlet head is disposed at the first end of the separating section, and an underflow is disposed at the second end.

The inlet head is coaxial with the central axis of the separating section and generally comprises a feed chamber having a continuous side wall having an inner side wall, a closed top or end wall and an open end that is disposed in connection with the separating section. The open end is of circular cross section.

The inlet head is structured with an inlet port positioned adjacent the top or end wall for delivering material to the feed chamber for processing and separation. In a preferred form, the inlet port is generally rectangular in cross section. The inlet port has a height dimension H1 that extends in a direction parallel to the central axis of the inlet head. The inlet head is also structured with an overflow outlet in the top or end wall which is coaxial with the central axis. A vortex finder extends from the top or end wall into the feed chamber in the direction of the central axis. The vortex finder extends a distance L1 from the top or end wall toward the feed chamber and separating section.

A feed inlet zone is located along the inner side wall of the feed chamber and has an upstream end adjacent the inlet port and a downstream end. The feed inlet zone is in the form of a volute having a volute axis extending around the inner side wall, and a plurality of sectors extending from the inlet port toward a downstream end of the inlet head. The volute axis is defined by a radius line which extends from the central axis of the inlet head toward the inner side wall of the inlet head.

Within the feed inlet zone there is a first sector, having a surface S1, in which the volute is generally flat to the horizontal plane, and second sector, having a surface S2. The surface S2 extends around the inner side wall generally in the direction of the central axis away from the top or end wall, wherein the distance from the volute axis to the central axis decreases with the progression of the volute away from the inlet port.

Preferably, the first sector of the feed inlet zone progresses from the inlet port around the inner side wall of the inlet head for an angle $\alpha$1 which ranges from 0° to 100°. Preferably the second sector extends in the direction of the central axis over a distance D ranging from 0.25 to 1.0 H1 for every 90° of progress around the inner side wall. The curve yielding the variation of the generatrix radius with the angle at the center may, for example, be a straight line or convex curve. Preferably, the second sector of the volute extends around the inner wall for an angle ranging from 200° to 380°.

BRIEF DESCRIPTION OF THE SEVERAL VIEWS OF THE DRAWINGS

In the drawings, which currently illustrate the best mode for carrying out the invention.

DETAILED DESCRIPTION OF THE INVENTION

Figure 1:
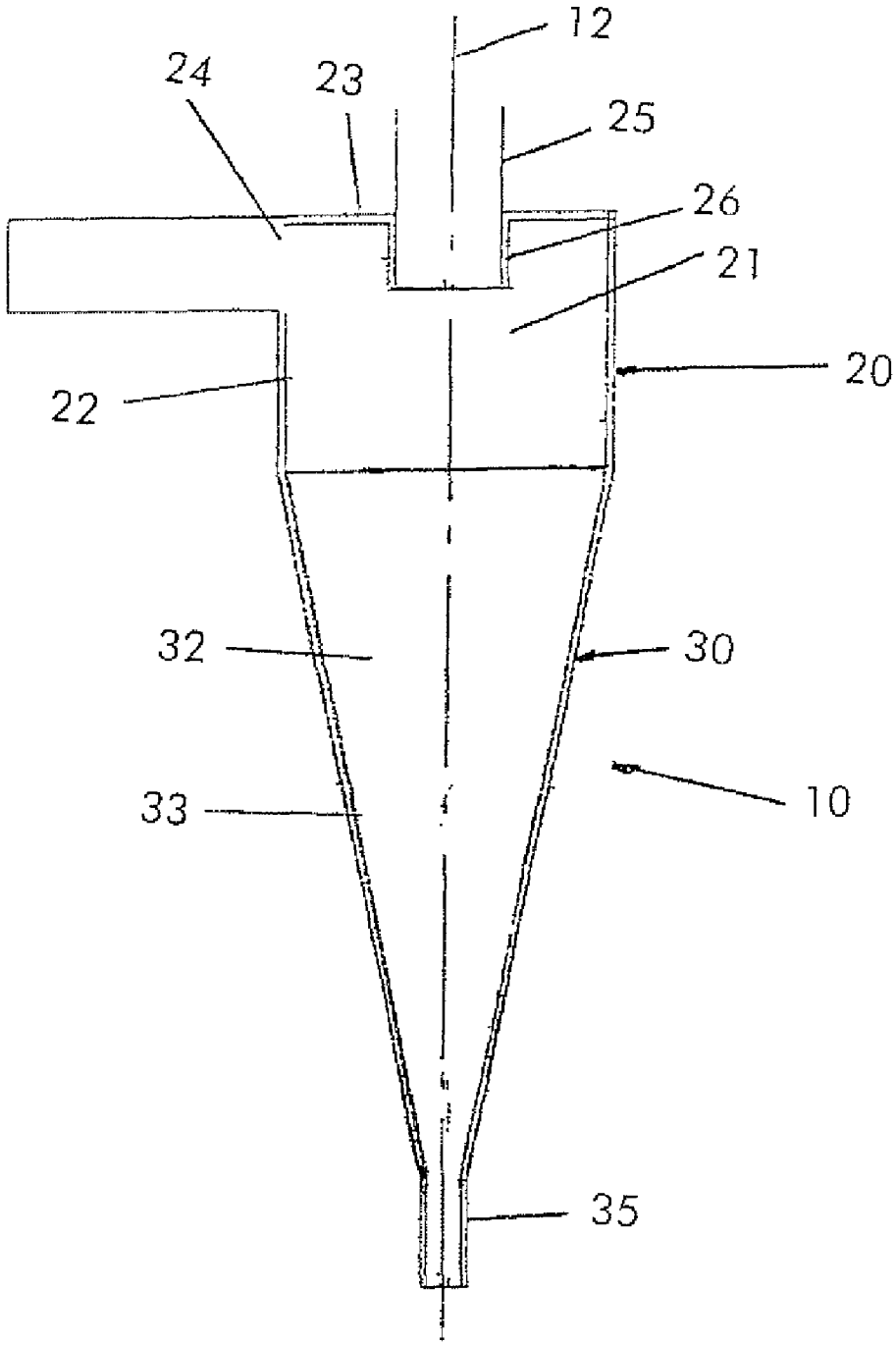
FIG. 1 (Prior Art)
FIG. 1 is a schematic cross-sectional side elevation of a conventional cyclone illustrating its main features.

FIG. 1 is a schematic side elevation of a conventional cyclone 10 illustrating its main features. The cyclone 10, when in use, is normally oriented with its central axis 12 being disposed upright. The cyclone 10 includes an inlet head 20 having a feed chamber 21 therein with an inner side wall 22 and a top wall 23. An inlet port 24 provides for delivery of material to be separated to the feed chamber 21. An overflow outlet 25 is provided in the top wall 23 and a vortex finder 26 extends into the feed chamber 21.

Downstream of the inlet head 20 is a separating section 30 which has a separating chamber 32 with a conically shaped inner wall 33. An under flow outlet 35 is provided at the end of the separating section 30.

Figure 2:
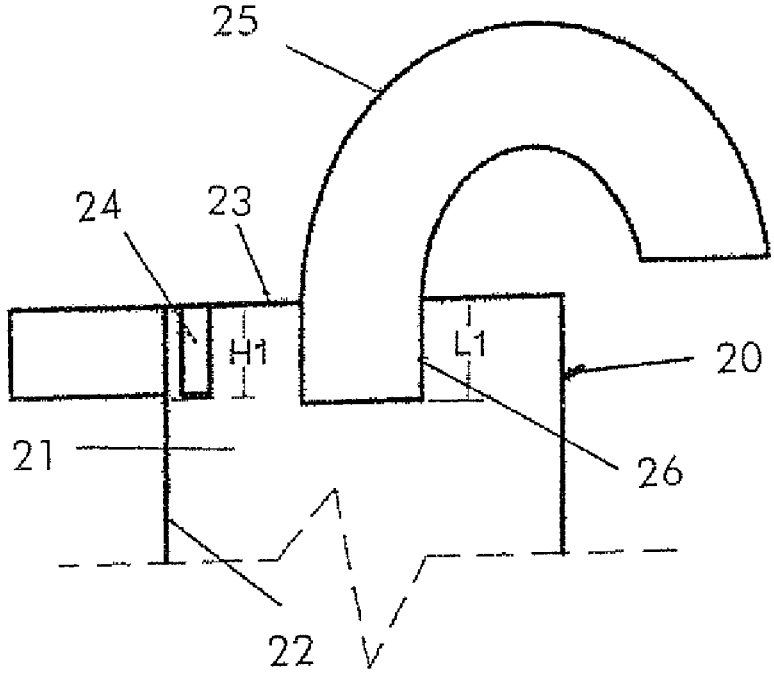
FIG. 2 (Prior Art)
FIG. 2 is a schematic cross-sectional side elevation of an inlet head of a conventional cyclone.
Figure 3:
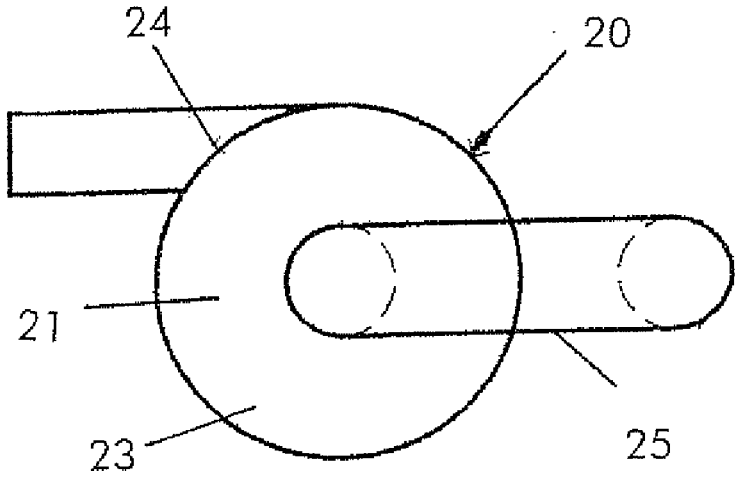
FIG. 3 (Prior Art)
FIG. 3 is a plan view of the inlet head shown in FIG. 2.

FIGS. 2 and 3 illustrate a conventional inlet head 20 which is currently known. As shown, the inlet port 24 is generally rectangular in cross section and has a height dimension H1, as measured in a direction parallel to the central axis 12 extending through the inlet head 20. The direction of feed material coming into the chamber 21 is generally tangential to the inner side wall 22.

The vortex finder 26 extends into the feed chamber 21 a distance L1 from the top wall 23. Generally, in known cyclones, L1 is greater than H1.

Figure 4:
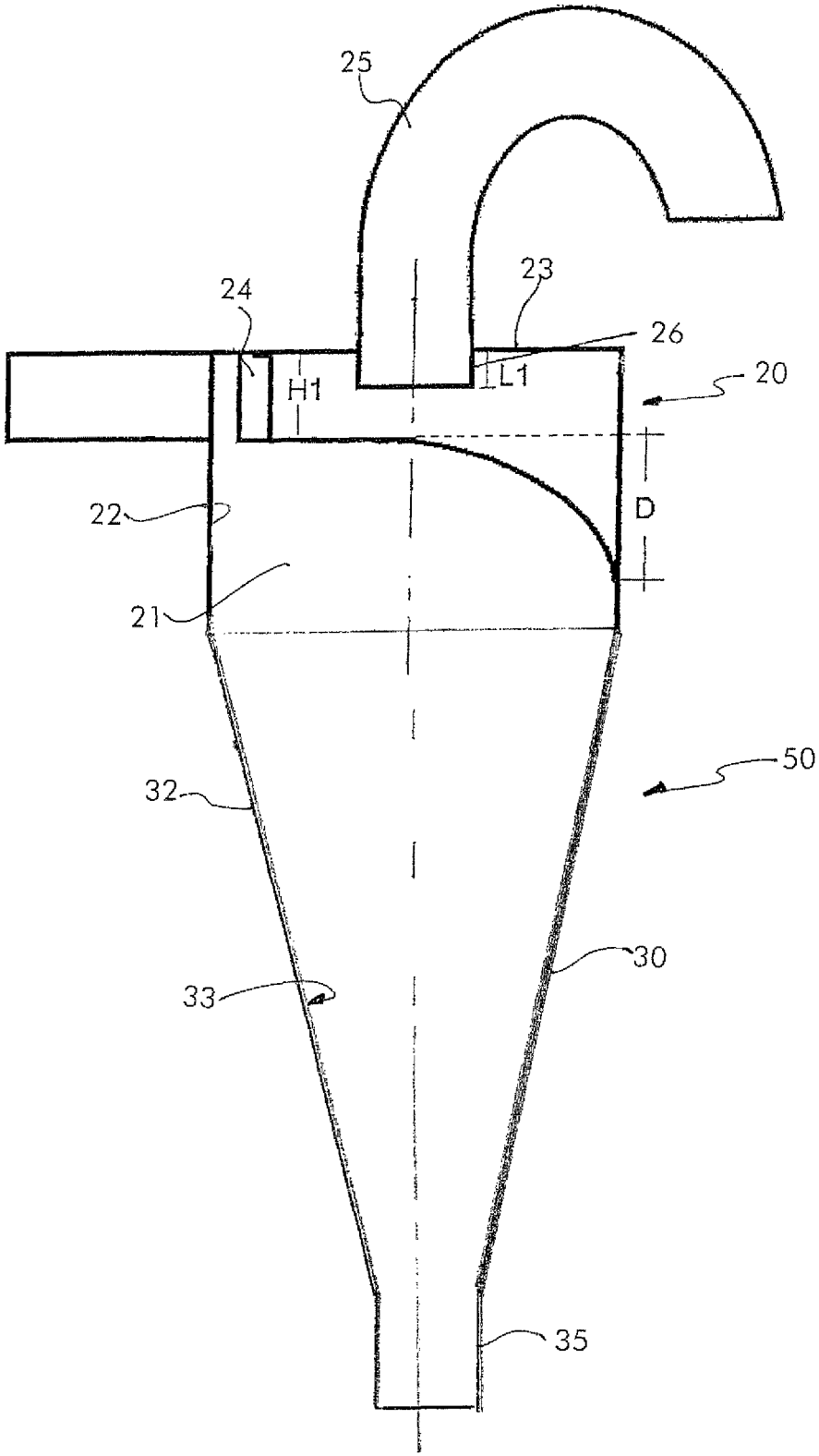
FIG. 4 is a schematic view in vertical cross section of a cyclone unit of the present invention.

FIG. 4 illustrates a cyclone of the present invention where like reference numerals to those used earlier have been used to identify similar, though not necessarily identical, parts. The present invention is particularly concerned with providing a cyclone having a separating section and an improved inlet head configuration. FIG. 4 thus illustrates a cyclone comprising a separating section 30 having an inlet head 20 configured in accordance with the present invention.

Figure 5:
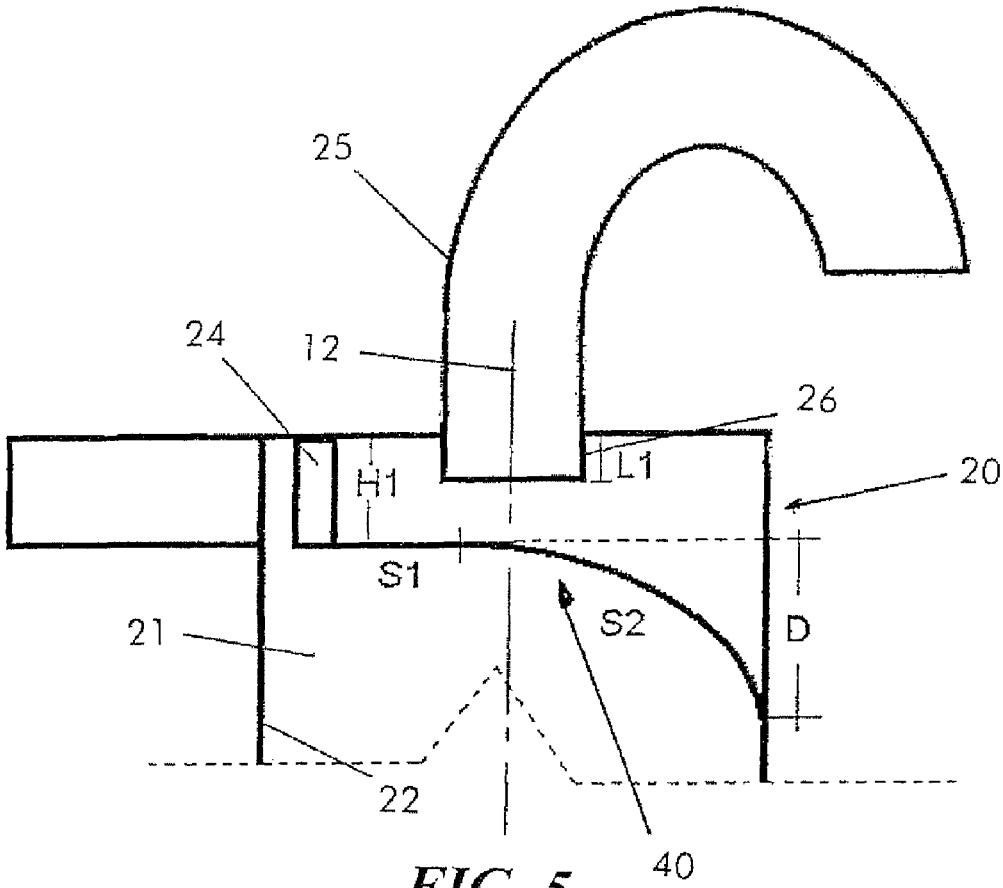
FIG. 5 is a schematic cross-sectional view of an inlet head for a cyclone according to the present invention.
Figure 6:
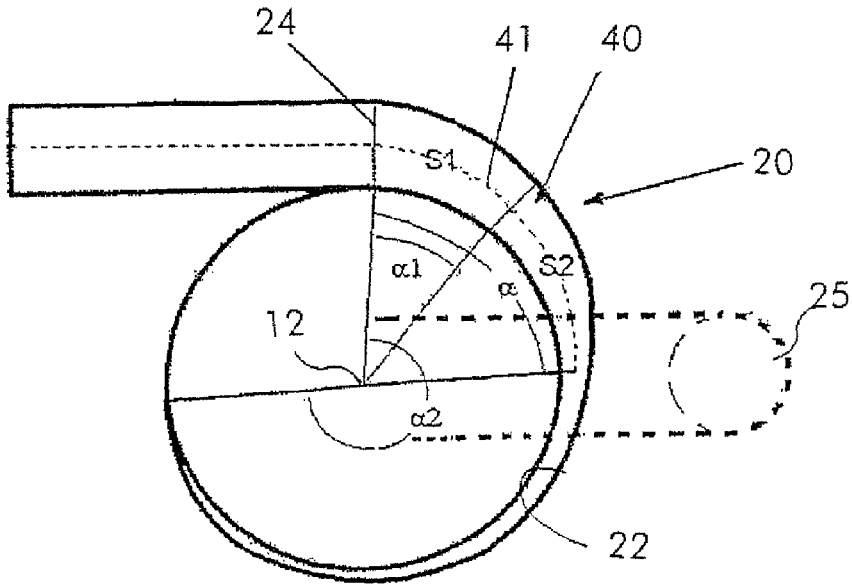
FIG. 6 is a plan view of the inlet head shown in FIG. 5.

The inlet head 20 of the present invention is shown in FIGS. 5 and 6. As shown, the inlet head 10 includes a feed inlet zone 40 which extends from the inlet port 24. The inlet zone 40 is in the form of a volute having a volute axis 41. The inlet zone 40 also includes a first sector S1, which is generally horizontally disposed and extends along the inner side wall 22 for an angle $\alpha$1, and a second sector S2 downstream of the first sector S1. The second sector S2 extends around the inner side wall 22 for an angle $\alpha$2 and downwardly in the direction parallel to the central axis 12 for a distance D for every 90° of progression around the inner side wall 22.

As shown, the distance between the volute axis 41 and the central axis 12 progressively decreases as the feed inlet zone progresses from the inlet port 24 downstream toward the separating section 30.

Furthermore, the length L1 of the vortex finder 26 is less than the height dimension H1 of the inlet port. It has been found that the fraction F (or ratio) of L1 to H1 can range from 0 to 0.95. Desirably distance D is from 0.25 H1 to H1 for every 90° progression of the volute axis 41 around the inner side wall 22. Additionally, the variation of the generatrix radius of the volute first sector S1 plus second sector S2 with the angle $\alpha$ must continuously decrease; that is it does not contain any singular points and preferably is a straight line or curve. The angle $\alpha$2 preferably ranges from 200° to 380°.

The cyclone separator of the present invention operates to effect a separation of different sizes and/or weights of material in a feed material mixture. The separation of the fractions is accomplished by introducing the feed material into the inlet port 24 where the feed material encounters the vortex finder 26 and the inner side wall 22 of the inlet head 20. As the feed material moves along the inner side wall 22, the feed material is subjected to the first sector S1 and subsequent sector S2 in which the vortex axis 41 progressively decreases. As the feed material moves through the sectors S1 and S2 downstream through the feed inlet zone, lighter weight fractions are separated from heavier weight fractions, the former being discharged through the overflow outlet 25 and the latter being discharged through the underflow outlet 35.

Finally, it is to be understood that various alterations, modifications and/or additions may be incorporated into the various constructions and arrangements of parts without departing from the spirit or ambit of the invention.

What is claimed is:

1. A cyclone, comprising:

a separating section having a first open end with a larger radius and a second end having a smaller radius;

an underflow outlet positioned at the second end of the separating section;

an inlet head positioned at the first open end of the separating section, the inlet head further comprising;

a feed chamber having a continuous, uninterrupted inner side wall;

a top wall at one end of the inner side wall;

an open end at the other end of the side wall opposite said top wall, the open end being of circular cross-section with a central axis;

an inlet port adjacent the top wall for delivering material to be separated to the feed chamber, the inlet port having a feed height dimension H1 in the direction of the central axis;

an overflow outlet in the top wall which is coaxial with the central axis; and a vortex finder at the top wall extending into the feed chamber in the direction of the central axis a distance L1 from the top end wall;

a feed inlet zone in the continuous, uninterrupted inner side wall of the feed chamber having an upstream end adjacent the inlet port and a downstream end extending away from said inlet port in a direction away from the top end wall, the feed inlet zone being defined by a volute having a volute axis extending around the continuous, uninterrupted inner side wall and including a first sector in which the volute is generally at right angles to the central axis and a second sector in which the volute extends around the continuous, uninterrupted inner side wall away from the top end wall and generally in the direction of the central axis a distance D, said second sector descending from the horizontal plane and extending in the direction of the central axis over a distance D ranging from 0.25×H1 to 1×H1 for every 90° of progress around the continuous, uninterrupted inner side wall; and wherein the distance from the volute axis to the central axis decreases with the progression of the volute around the continuous, uninterrupted inner side wall in a direction away from the inlet port.

2. The cyclone according to claim 1 wherein the ratio of the distance L1 to the height dimension H1 is less than one.

* * * * *